US007134172B2

(12) United States Patent
Sakamoto et al.

(10) Patent No.: US 7,134,172 B2
(45) Date of Patent: Nov. 14, 2006

(54) METHOD OF MANUFACTURING A MULTI-NOZZLE INK JET HEAD

(75) Inventors: Yoshiaki Sakamoto, Kawasaki (JP); Shuji Koike, Setagaya (JP); Tomohisa Shingai, Kawasaki (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 18 days.

(21) Appl. No.: 11/101,388

(22) Filed: Apr. 8, 2005

(65) Prior Publication Data

US 2005/0168538 A1 Aug. 4, 2005

Related U.S. Application Data

(60) Division of application No. 10/253,821, filed on Sep. 25, 2002, now Pat. No. 6,921,159, which is a continuation of application No. PCT/JP00/01882, filed on Mar. 27, 2000.

(51) Int. Cl.
*H04R 17/00* (2006.01)
*B21D 53/76* (2006.01)

(52) U.S. Cl. ..... 29/25.35; 29/890.1; 310/367; 310/311

(58) Field of Classification Search ..... 29/25.35, 29/890.1, 846; 310/311, 367; 347/68, 70, 347/71

See application file for complete search history.

(56) References Cited

U.S. PATENT DOCUMENTS

| | | | | |
|---|---|---|---|---|
| 5,471,232 A * | 11/1995 | Hosono et al. | ..... | 347/70 |
| 5,784,085 A | 7/1998 | Hosono et al. | ..... | 347/70 |
| 6,217,158 B1 | 4/2001 | Kanaya et al. | ..... | 347/70 |
| 6,584,660 B1 * | 7/2003 | Shimogawa et al. | ..... | 29/25.35 |

FOREIGN PATENT DOCUMENTS

| | | | |
|---|---|---|---|
| JP | 58-108163 | 6/1983 | |
| JP | 5-286132 | * 11/1983 | ..... 29/890.1 |
| JP | 1-204748 | 8/1989 | |
| JP | 09-295402 | 11/1997 | |
| JP | 2000-006395 | 1/2000 | |

* cited by examiner

*Primary Examiner*—A. Dexter Tugbang
(74) *Attorney, Agent, or Firm*—Armstrong, Kratz, Quintos, Hanson & Brooks, LLP.

(57) ABSTRACT

In a method of manufacturing a multi-nozzle ink jet head having a plurality of nozzles, cross talk between adjacent elements is suppressed. The head has the nozzles (12), pressure chambers (15), and bimorph drivers. The bimorph drivers have piezos (19) formed on a diaphragm (18). The diaphragm (18) has linear parts (18-1) that convert the generated force from the piezos (19) into displacement, and non-linear parts (18-2) that are provided between the linear parts (18-1) and diaphragm fixing parts. Due to the non-linear parts (18-2), transmission of strain energy to the fixing parts is suppressed, and hence cross talk is suppressed.

3 Claims, 10 Drawing Sheets

| PROCESS SIZE | |
|---|---|
| PI LAMINATION | (μm) |
| t1 | 5.7 |
| t2 | 5.5 |
| t3 | 2.2 |

| PROCESS SIZE | |
|---|---|
| PI LAMINATION | (μm) |
| t1 | 7.2 |
| t2 | 5.5 |
| t3 | 2.2 |

| PROCESS SIZE | |
|---|---|
| PI LAMINATION | (μm) |
| t1 | 8.2 |
| t2 | 5.5 |
| t3 | 2.2 |

FIG. 9

| | WHEN 15V DRIVING | | | | | | CHANGE MULTI-ELEMENT DRIVING FOR SINGLE ELEMENT DRIVING | | |
|---|---|---|---|---|---|---|---|---|---|
| | SINGLE ELEMENT DRIVING A | | | MULTI-ELEMENT DRIVING B | | | CROSS TALK RATE (B=A)/A | | |
| | PARTICLE SPEED | PARTICLE VOLUME | MAXMUM DISPLACE-MENT | PARTICLE SPEED | PARTICLE VOLUME | MAXMUM DISPLACE-MENT | PARTICLE SPEED | PARTICLE VOLUME | MAXMUM DISPLACE-MENT |
| | (m/s) | (pL) | (nm) | (m/s) | (pL) | (nm) | | | |
| PRIOR ART | 6.3 | 10.1 | 115 | 6.7 | 10.3 | 121 | 6% | 2% | 6% |
| EXAMPLE 1 | 6.2 | 9.9 | 113 | 6.5 | 10.0 | 117 | 5% | 1% | 4% |
| EXAMPLE 2 | 6.3 | 10.0 | 113 | 6.5 | 10.0 | 116 | 4% | 0% | 3% |
| EXAMPLE 3 | 6.3 | 10.1 | 113 | 6.6 | 10.1 | 116 | 4% | 0% | 3% |

FIG. 10

| | COMPRATIVE WITH THE VALUE OF PRIOR ART TAKEN "1" IN CROSS TALK RATE | | |
|---|---|---|---|
| | PARTICLE SPEED | PARTICLE VOLUME | MAXMUM DISPLACE-MENT |
| PRIOR ART | 1 | 1 | 1 |
| EXAMPLE 1 | 0.71 | 0.28 | 0.64 |
| EXAMPLE 2 | 0.65 | 0.04 | 0.52 |
| EXAMPLE 3 | 0.65 | −0.01 | 0.49 |

METHOD OF MANUFACTURING A MULTI-NOZZLE INK JET HEAD

This application is a divisional application of prior application Ser. No. 10/253,821, filed on Sep. 25, 2002, and now U.S. Pat. No. 6,921,159, which is a continuation of international application PCT/JP00/01882, filed on Mar. 27, 2000.

TECHNICAL FIELD

The present invention relates to a multi-nozzle ink jet head using piezo elements and a manufacturing method thereof, and in particular to a multi-nozzle ink jet head for reducing mechanical interference between adjacent elements and a manufacturing method thereof.

BACKGROUND ART

FIG. 14 is a drawing of the constitution of a conventional multi-nozzle ink jet head. This head 10 shows an example of the application of bimorph actuators in which a diaphragm 102 and a piezo elements 101 are laminated together as driving elements. Regarding the method of producing this head, a plurality of individual electrodes 100 are formed by sputtering on an MgO substrate, not shown, and the piezos 101 are further laminated on to a thickness of a few μm, and pattern formation is carried out. After this, a metal (for example Cr) that will become the common electrode cum diaphragm 102 is formed to a few μm over the whole surface, thus forming the bimorph structures.

A pressure chamber forming member (dry film resist) 103 and a nozzle forming member 105, which are prepared separately, are then joined on, with positional alignment being carried out with the individual electrodes 100 of the bimorph structures. After that, the MgO substrate is removed by etching, thus completing the multi-nozzle head plate 10.

Regarding the operation of this head 10, ink is fed to the head 10 from an ink tank, not shown, and then within the head 10, the ink is fed through a common channel and ink supply channels to pressure chambers 104 and nozzles 106. Driving signals are applied to the individual electrodes (the electrodes corresponding to the respective nozzles) 100 from a driving circuit, whereupon, due to the piezoelectric effects of the piezo 101, the diaphragm 102 bends towards the inside of the pressure chamber 104 as shown by the dashed line in FIG. 14, and hence ink is ejected from the nozzle 106. The ink forms dots on a printing medium, thus forming a desired image.

Regarding the deformation during driving shown by the dashed line in FIG. 14, a strain force due to the piezoelectric effects of the piezo 101 (in particular the transverse effect orthogonal to the electric field) acts as a bending moment at the bending section neutral axis due to differences in the sectional shape (in particular the thickness) and the Young's modulus between the electrode 100, the piezo 101 and the diaphragm 102, and hence the bimorph structure which comprises the electrode 100, the piezo 101 and the diaphragm 102 as a whole bends.

To make this bending act so that the ink in the pressure chamber 104 flows, it is necessary to fix the bimorph structure to the pressure chamber 104. As a result, it becomes possible for the surface of the diaphragm 102, which bends with the fixed part as a reference position, to change the volume of the pressure chamber 104, whereupon ink is ejected.

As shown in the schematic drawing of FIG. 15, in the multi-nozzle ink jet head 10 in which the volume of the pressure chambers 104 is changed by bending of the diaphragm 102, if the density of the nozzles 106 is made high, then the walls 103 between the pressure chambers 104 communicating with adjacent nozzles 106 (the pressure chamber walls) become thin. That is, the fixing parts of the diaphragm 102 become narrow. For example, in a 150 dpi head, the nozzle spacing is about 169 μm, and hence it is necessary to make the thickness of the pressure chamber walls 103 35 μm.

This reduces the rigidity of the fixing parts 103 of the diaphragm 102, and hence the fixing parts 103 no longer function sufficiently as fixed ends of the diaphragm 102. As a result, in the case of a structure in which adjacent pressure chambers 104 are covered by the same diaphragm 102, when a single part of the diaphragm bends (single-element driving), the part of the diaphragm for the adjacent element is pulled in in the direction A of the bending, i.e. it is difficult for local bending of only the driven part to occur. Moreover, as shown in FIG. 15, when various parts of the diaphragm 102, including the parts at adjacent elements, bend together (multi-element driving), the parts of the diaphragm 102 on either side of the fixing part 103 pull against one another in the directions of the arrows A and B, and the two pulls balance one another, and hence it is easy for local bending of only the driven parts to occur.

In this way, mechanical driving interference (cross talk) occurs in which the bending of the diaphragm 102 differs according to the driving state (single-element driving or multi-element driving). In the ink jet head, this manifests itself as fluctuations in the ink flight characteristics, resulting in a drop in printing quality.

Moreover, a technique is known for dividing a single diaphragm 102 into parts for each of the pressure chambers 104, but with thin pressure chamber walls 103, it is very difficult to secure the reliability of the diaphragm fixing parts (the structure that functions as fixed ends for the diaphragm and also seals the pressure chambers) if the nozzle density is high. Moreover, even if the diaphragm is divided, the strain energy that the piezos 101 exert on the fixed ends of the diaphragm 102 will not change, and hence the energy transmitted to adjacent elements via the pressure chamber walls 103 will not change. As a result, in a high-density head in which the pressure chamber walls are thin, dividing the diaphragm is not an effective measure for solving the problem, and cross talk cannot be prevented.

DISCLOSURE OF THE INVENTION

It is an object of the present invention to provide a multi-nozzle ink jet head and a manufacturing method thereof for suppressing cross talk even in the case of a high nozzle density.

It is another object of the present invention to provide a multi-nozzle ink jet head and a manufacturing method thereof for suppressing strain energy in the diaphragm due to the generated force of the piezos from acting on the fixing parts.

It is yet another object of the present invention to provide a multi-nozzle ink jet head and a manufacturing method thereof for suppressing cross talk, and increasing the amount of displacement of the bimorph parts.

To attain these objects, a multi-nozzle ink jet head of the present invention has a head substrate in which are formed a plurality of nozzles and a plurality of pressure chambers, a diaphragm that covers the plurality of adjacent pressure chambers, a plurality of piezo elements provided on the diaphragm that are provided in correspondence with the pressure chambers, and a plurality of individual electrodes provided respectively on the piezo elements, wherein the cross-section of the diaphragm has linear parts provided in regions of the piezo elements, and non-linear parts provided between the linear parts and the walls of the pressure chambers.

In the present invention, the degree of flatness of the diaphragm is reduced between adjacent driving elements, so that when the part of the diaphragm at one of the driving elements is displaced, it will be difficult for tensile force to be transmitted to the part of the diaphragm at the other driving element. As a result, the amount of displacement is prevented from being different between single-element driving and multi-element driving, and hence fluctuations in ink flight characteristics are suppressed. To this purpose, in the present invention, the cross-section of the diaphragm is made to have a linear shape in the regions of the piezo elements of the bimorph drivers, and a non-linear shape between the linear parts and the pressure chamber walls. The non-linear shape suppresses strain energy generated in the linear parts of the diaphragm from acting on the pressure chamber walls. As a result, transmission of energy to adjacent elements can be suppressed, and hence cross talk can be suppressed. Moreover, because the regions of the diaphragm at the piezo elements are made to have a linear shape, the amount of displacement of the bimorph drivers is not reduced.

Moreover, with the multi-nozzle ink jet head of the present invention, through the non-linear parts of the diaphragm having a shape such that strain energy in the diaphragm due to the piezo elements is suppressed from being transmitted to the walls of the pressure chambers, cross talk can be suppressed.

With the multi-nozzle ink jet head of the present invention, by making the non-linear parts of the diaphragm have a curved or crank shape, a diaphragm having a cross-sectional shape such that transmission of strain energy is suppressed can easily be produced.

With the multi-nozzle ink jet head of the present invention, by forming the non-linear parts of the diaphragm over the whole length (on the longitudinal axis direction) of the pressure chambers, cross talk to adjacent elements can be completely suppressed.

With the multi-nozzle ink jet head of the present invention, by making the non-linear parts of the diaphragm have a shape that is convex in the direction in which the diaphragm bends due to the piezo elements, it becomes such that the diaphragm bends easily, and the amount of displacement of the bimorph drivers can be increased.

With the multi-nozzle ink jet head of the present invention, through the diaphragm being constituted from a diaphragm common to the plurality of pressure chambers, the bimorph drivers can be fixed reliably even in the case of thin pressure chamber walls, and hence cross talk can be suppressed while maintaining the displacement characteristics of the bimorph drivers.

A method of manufacturing a multi-nozzle ink jet head of the present invention has a step of forming a plurality of individual electrodes on a substrate, a step of forming a plurality of piezo elements respectively on the individual electrodes, a step of forming, on the substrate, an insulating layer having rising parts between the regions in which the piezo elements are provided and the walls of the pressure chambers, a step of forming a diaphragm layer on the insulating layer, and a step of forming, on the diaphragm layer, a head substrate in which are formed a plurality of nozzles and a plurality of pressure chambers, such that the piezo elements are respectively positioned at the pressure chambers.

With this form, because rising parts are formed between regions of the insulating layer where the piezo elements are provided and the walls of the pressure chambers, the linear parts and the non-linear parts of the diaphragm can be formed easily.

Moreover, with the method of manufacturing a multi-nozzle ink jet head of the present invention, by making the step of forming the piezo elements comprise a step of forming piezo elements having tapered parts at both ends, and making the step of forming the insulating layer comprise a step of forming an insulating layer having the rising parts at the tapered parts of the piezo elements, cross talk can be suppressed without reducing the width of the piezo elements. Cross talk can thus be suppressed without reducing the amount of displacement of the bimorph drivers.

Furthermore, with the method of manufacturing a multi-nozzle ink jet head of the present invention, by making the step of forming the diaphragm layer comprises a step of forming a diaphragm layer common to the plurality of pressure chambers, the bimorph drivers can be fixed reliably even in the case of thin pressure chamber walls, and hence cross talk can be suppressed while maintaining the displacement characteristics of the bimorph drivers.

Other objects and forms of the present invention will become apparent from the following drawings and embodiments.

BRIEF DESCRIPTION OF THE DRAWINGS

FIG. 9 is a table of head characteristics for the examples of FIG. 8.

FIG. 10 is a table of cross talk suppression characteristics for FIG. 8.

BEST MODE FOR CARRYING OUT THE INVENTION

Figure 1:
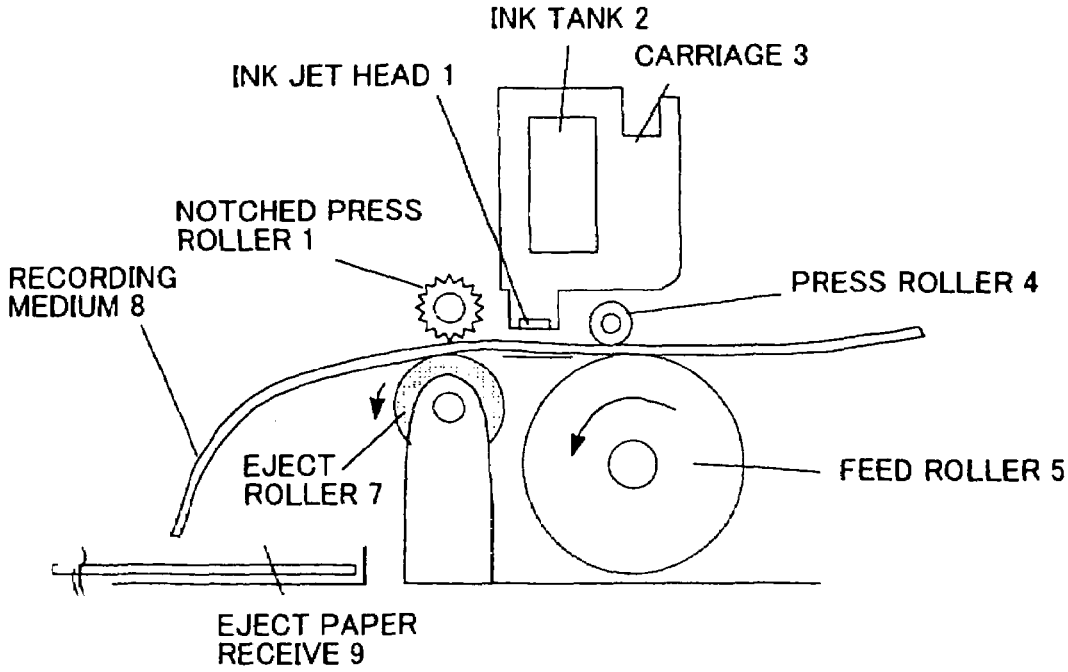
FIG. 1 is a drawing of the constitution of an ink jet printer to which the multi-nozzle ink jet head of an example of the present invention is applied.

FIG. 1 is a drawing of the constitution of an ink jet printer to which the ink jet head of an example of the present invention is applied, and shows a serial printer. In FIG. 1, a carriage 3 moves in the principal scanning direction of a recording medium 8. The carriage 3 has therein an ink tank 2 that stores ink, and the ink jet head 1 of the present invention.

The recording medium 8 is conveyed in the direction of the head 1 by a paper-feeding roller 5 and a pressing roller 4, and is conveyed in the direction of a discharged paper receiver 9 by a paper-discharging roller 7 and a notched pressing roller 6. Through the conveyance of the recording medium 8 in the secondary scanning direction and the movement of the carriage 3 in the principal scanning direction, the head 1 carries out printing over the whole of the recording medium 8.

Figure 2:
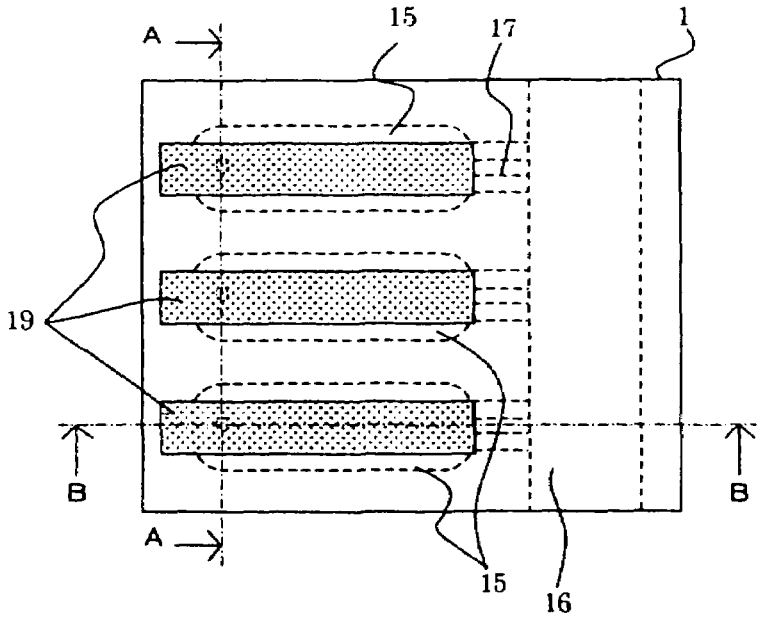
FIG. 2 is a top view of a multi-nozzle head of an example of the present invention.
Figure 3:
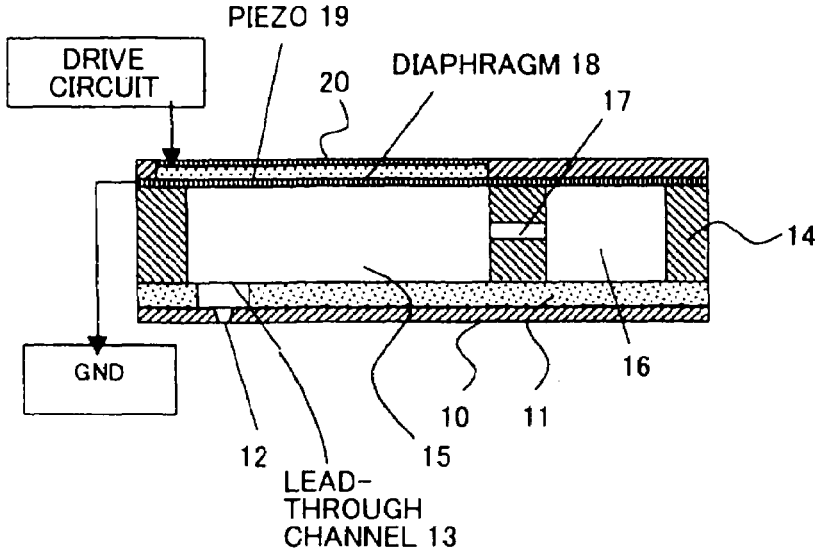
FIG. 3 is a sectional view of FIG. 2 along B—B.
Figure 4:
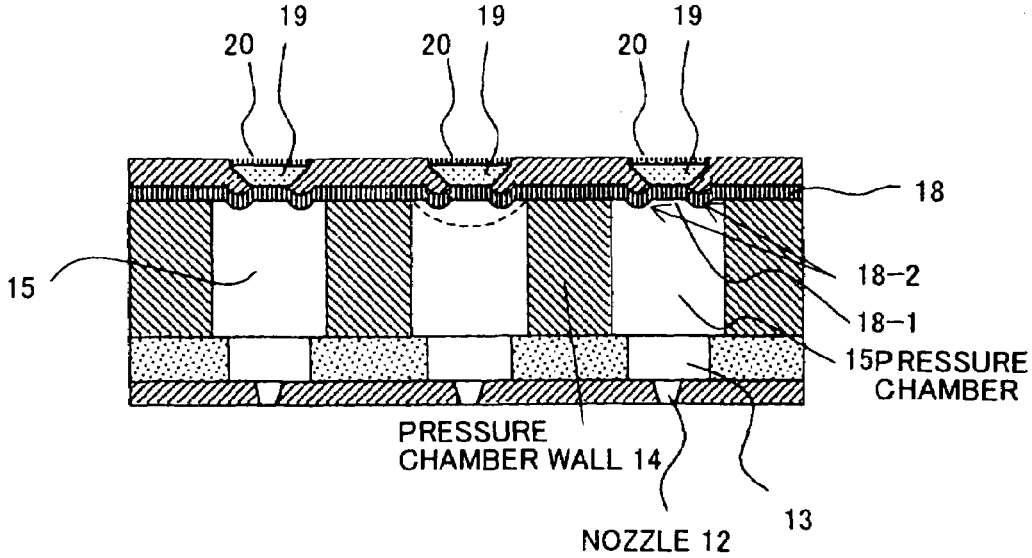
FIG. 4 is a sectional view of FIG. 2 along A—A.

FIG. 2 is a top view of the multi-nozzle ink jet head (hereinafter referred to as the 'head') 1, FIG. 3 is a sectional view of the head of FIG. 2 along B—B, and FIG. 4 is a sectional view of the head of FIG. 2 along A—A.

As shown in FIG. 2, the head 1 has three nozzles. That is, for one common ink chamber 16, three piezoelectric elements (piezos) 19 are provided, and three pressure chambers 15 are provided via ink supply channels 17. As shown in FIG. 3, bimorph actuators in which the piezo elements 19 are laminated on a diaphragm 18 are used as driving elements.

Regarding the method of producing the head, a plurality of individual electrodes 20 are formed by sputtering on an MgO substrate, not shown, the piezos 19 are further laminated on to a thickness of a few μm, and pattern formation is carried out. After this, a metal (for example Cr) that will become the common electrode cum diaphragm 18 is formed to a few μm over the whole surface, thus forming the bimorph structures.

A pressure chamber forming member (dry film resist) 14 and nozzle forming members 10 and 11, which are prepared separately to the above, are then joined on, with positional alignment being carried out with the individual electrodes 20 of the bimorph structures. After that, the MgO substrate is removed by etching, thus completing the multi-nozzle head plate 1.

Regarding the operation of this head 1, ink is fed to the head 1 from the ink tank 2 of FIG. 1, and then within the head 1, the ink is fed through the common channel 16 and the ink supply channels 17 to the pressure chambers 15 and nozzles 12. The diaphragm 18 is electrically earthed, and driving signals are applied to the individual electrodes (the electrodes corresponding to the respective nozzles) 20 from driving circuitry, whereupon, due to the piezoelectric effects of the piezo 19, the diaphragm 18 bends towards the inside of the pressure chamber 15 as shown in FIG. 4, and hence ink is ejected from the nozzle 12. The ink forms dots on the printing medium, thus forming a desired image.

Regarding the deformation during driving shown by the dashed line in FIG. 4, a strain force due to the piezoelectric effects of the piezo 19 (in particular the transverse effect orthogonal to the electric field) acts as a bending moment at the bending section neutral axis due to differences in the sectional shape (in particular the thickness) and the Young's modulus between the electrode 20, the piezo 19 and the diaphragm 18, and hence the bimorph structure which comprises the electrode 20, the piezo 19 and the diaphragm 18 as a whole bends.

To make this bending act so that the ink in the pressure chamber 15 flows, it is necessary to fix the bimorph structure to the pressure chamber 15. As a result, it becomes possible for the surface of the diaphragm 18, which bends with the fixed part as a reference position, to change the volume of the pressure chamber 15, whereupon ink is ejected. Specifically, walls 14 forming the pressure chamber 15 fix the diaphragm 18.

As shown in FIG. 4, with the multi-nozzle ink jet head 1, in which the volume of the pressure chambers 15 is changed by the bending of the diaphragm 18, if the density of the nozzles 12 is made high, then the walls 14 between the pressure chambers 15 communicating with adjacent nozzles 12 (the pressure chamber walls) become thin. That is, the fixing parts for the diaphragm 18 become narrow. For example, in a 150 dpi head, the nozzle spacing is about 169 μm, and hence it is necessary to make the thickness of the pressure chamber walls 14 35 μm.

As shown in FIG. 4, the head 1 of the present invention has a structure in which a plurality of adjacent pressure chambers 15 are covered by the same diaphragm 18, and at at least part of each of the regions between adjacent driving elements, the cross-section of the diaphragm is not linear, but rather is made to be a non-linear cross-section 18-2 having a curved shape or a crank shape. These (curved or crank-shaped) non-linear irregular cross-section parts 18-2 of the diaphragm are formed between the pressure chamber walls 14 in a direction going away from the driving elements 19.

The non-linear irregular cross-section parts 18-2 of the diaphragm 18 are formed in the width direction (minor axis direction) of the pressure chambers. Moreover, the non-linear irregular cross-section parts 18-2 of the diaphragm 18 are formed uniformly over the whole length (in the longitudinal axis direction) of the pressure chambers 15. The piezos 19 are thin-film piezos of thickness 5 μm or less. Each non-linear irregular cross-section part 18-2 of the diaphragm 18 is provided in a region where the diaphragm 18 bends during driving, such that not all of the non-linear irregular cross-section part 18-2 is contained in the joining part of the diaphragm 18 with the pressure chamber wall 14 (the diaphragm fixing part).

Figure 5A:
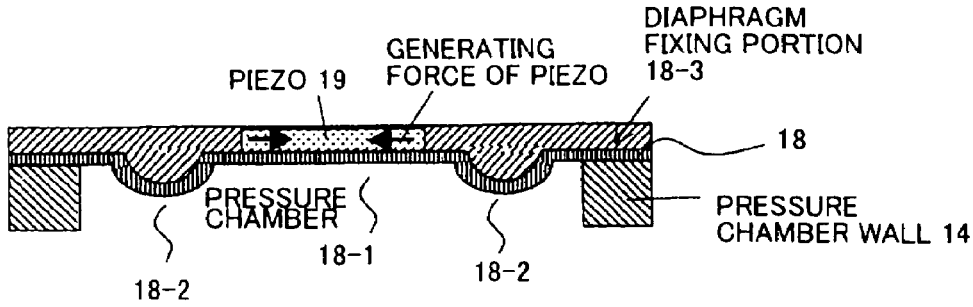
FIGS. 5(A), 5(B) and 5(C) consist of drawings explaining the operation of the diaphragm of FIG. 4.

FIG. 5 consists of drawings explaining the operation of the diaphragm 18 in which non-linear cross-section parts 18-2 are provided. FIG. 5(A) is a model diagram; the diaphragm 18 has regions of linear shape 18-1 where the piezo 19 is installed, and non-linear parts 18-2 are provided at each end of each piezo 19 between the piezo 19 and the pressure chamber wall 14. In the drawings, the strain energy in the diaphragm 18 due to the generated force from the piezo 19 is analyzed.

Figure 5B:
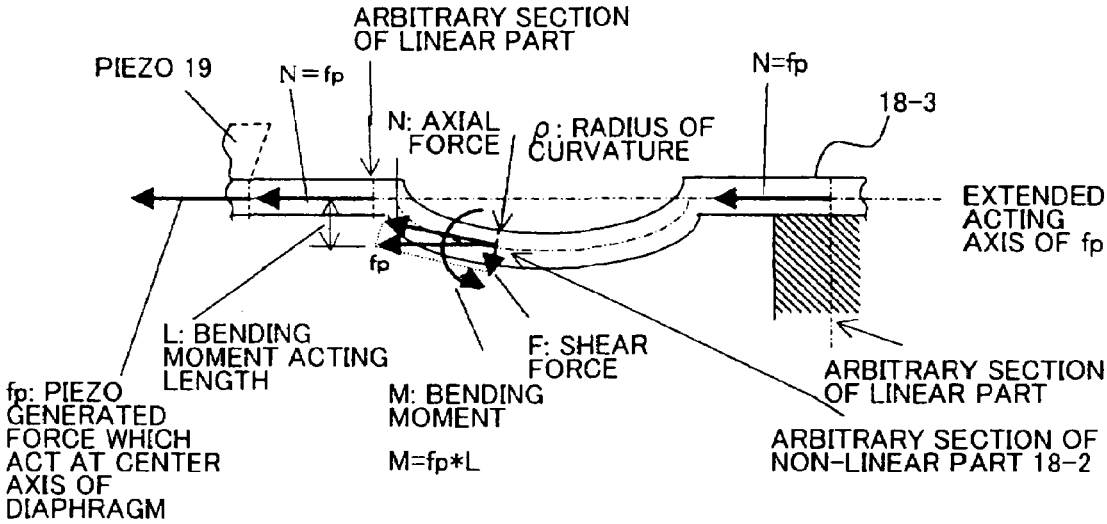

FIG. 5(B) is an analytical model diagram. A generated force fp from the piezo 19 acts at the central axis of the diaphragm 18. The axial force is N. Taking the radius of curvature of the non-linear part 18-2 to be ρ, the piezo generated force fp at an arbitrary section of the non-linear part 18-2 is split by vector resolution into the axial force N and the shear force F. As a result, a bending moment M (=fp·L) arises at this section. L is the bending moment acting length. The strain energy U acting on the diaphragm 18 that passes into the diaphragm fixing part 18-3 from the piezo 19 can thus be represented by the following formula.

$$U=Un+Uf+Um+Umn$$

Here, Un is the strain energy due to the axial force N,

Uf is the strain energy due to the shear force F,

Um is the strain energy due to the bending moment M, and

Umn is the strain energy due to the strain of the bending moment M and the axial force N.

Of these strain energy components, Um and Umn, which arise through the bending moment M, and Uf, which arises through the shear force F, are expended by the deformation of the non-linear part 18-2. Relative to the direction of the piezo generated force acting on the diaphragm 18 (here, contraction in the d31 direction), the bending moment M and the shear force F are generated due to a shape where the diaphragm does not lie on the line of extension in this direction, i.e. due to the non-linear part 18-2.

Moreover, by providing the convex portion of the non-linear part 18-2 in the direction in which the bimorph element is deformed, the amount of deformation of the bimorph element is increased. That is, the deformation of the non-linear part 18-2 acts in a direction so as to make the radius of curvature ρ of the non-linear part 18-2 larger, and as a result the amount of deformation of the bimorph element is increased. From an opposite standpoint, the driving voltage required to obtain a certain prescribed displacement can be reduced.

Figure 5C:
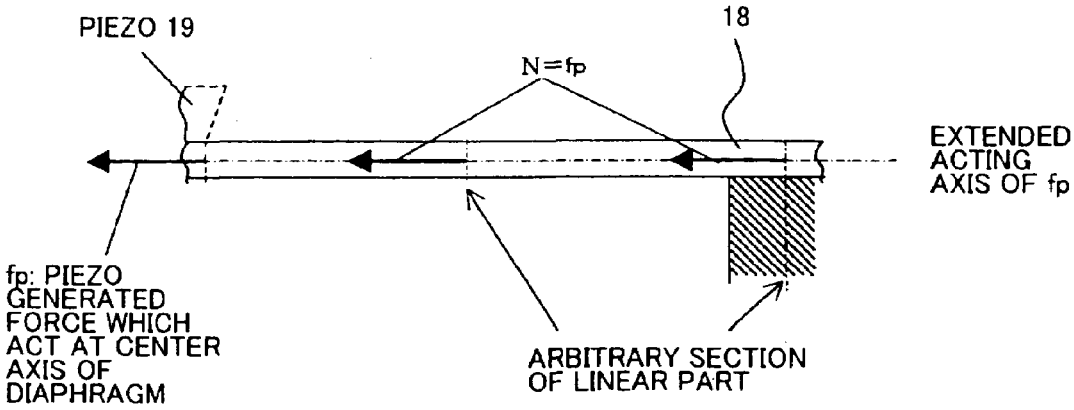

In the case of a conventional diaphragm that has a purely linear cross-section, on the other hand, as shown in FIG. 5(C), no bending moment is generated. The strain energy Un thus acts directly on the diaphragm 18 fixing part from the diaphragm 18. Comparing using the strain energy u due to the piezo generated force fp, in the present invention, the energy is partitioned into Uf, Um and Umn, and hence the strain energy acting on the fixing part is reduced. The energy transmitted to the adjacent element via the pressure chamber wall is thus reduced, i.e. cross talk can be reduced.

Furthermore, the present invention is effective even if applied to a diaphragm that is divided into a plurality of diaphragms. That is, when the diaphragm is divided into a plurality of diaphragms by the pressure chamber walls, then force will not act directly for each of the diaphragms, but because each of the diaphragms is fixed to the same pressure chamber wall, there will be an interaction between adjacent elements via the fixing to this wall, and hence cross talk will occur. In particular, this will be marked in the case that the pressure chamber walls are thin and the rigidity is low.

With the present invention, because the strain energy acting on the fixing parts is itself low compared with the strain energy U due to the piezo generated force fp, the energy transmitted to adjacent elements via the pressure chamber walls becomes low, and hence cross talk can be reduced yet further, even in the case of a divided diaphragm.

As a result, in the case of a structure having an increased nozzle density, i.e. a structure in which the diaphragm fixing parts are narrow, mechanical cross talk between adjacent elements can be suppressed, while securing the diaphragm fixing. In particular, in the case of a bimorph diaphragm structure using thin-film piezos of thickness 5 μm or less as actuators, the effects are marked, contributing greatly to increasing the nozzle density and making the head smaller.

Moreover, it is desired to improve the printing quality (resolution, speed) of print recording apparatuses, and in the case of an ink jet printer, this can be realized by making the ink particles smaller (making the dots finer) and increasing the number of nozzles. A bimorph actuator using a thin-film piezo is considered to be extremely promising as the driving element required in this case. Such a thin-film piezo is formed thinly and has a high piezoelectric constant, and hence bending is easy at a low driving voltage, and achieving high integration is made easy through semiconductor manufacturing methods.

Next, a method of manufacturing the above head will be described using FIGS. 6 and 7. In this example, the method of producing the thin-film piezos is the same as conventionally, but by carrying out the dividing of the piezos by etching, the piezo edge cross-section was made to have a tapered shape. As a result, the curved shape of the diaphragm can easily be produced.

(1) Individual electrodes 20 are formed in the required shape by Pt sputter patterning on an MgO substrate 30.

(2) A piezo layer 19 is formed over the whole of (1) by sputtering.

(3) A resist pattern is formed on the piezo layer 19 of (2) by photolithography, and then the piezo layer 19 is divided by chemical etching such that piezos are left behind on the individual electrode parts. At this time, the piezo edge cross-section becomes a tapered shape through the chemical etching. The piezo width is 90 (μm) on the individual electrode side, and 70 (μm) on the diaphragm side.

(4) A photosensitive polyimide (PI) 31 is spin-coated over the whole of (3). The thickness of the PI 31 is t1 (μm).

(5) The PI (insulating layer) 31 of (4) is subjected to exposure and development. The PI 31 is left behind in the regions where the diaphragm cross-section is to be made curved. Here, as shown in the drawing, the portions of the PI on the tapered edge faces of the piezos 19 are left behind.

(6) A photosensitive polyimide (PI) 32 is spin-coated over the whole of (5), and exposure is carried out. At this time, the newly applied PI 32 is formed to a thickness of 1 μm on the upper surface of the PI 31 that was produced in (5), and moreover the surface of the applied PI 32 becomes smooth due to surface tension. The thickness of the PI 32 is t2 (μm).

(7) A certain required amount is removed from the surface of the PI 32 by ICP etching (using a high-frequency inductively coupled type plasma apparatus). As a result, the curved shape is formed. The amount removed is t3 (μm).

(8) A common electrode cum diaphragm 18 is formed over the whole of (7) by Cr sputtering.

(9) Pressure chamber wall base parts 14-1 are formed on (8) by dry film resist patterning. Here, the ink supply channels 17 are formed by laminate patterning of the dry film resist.

(10) Pressure chamber wall base parts 14-2 are formed by dry film resist patterning on a nozzle substrate (a laminated plate of a nozzle plate 10 and a lead-through channel plate 11) that has been produced separately.

(11) (9) and (10) are aligned, joining is carried out with heating, and then the MgO 30 of the piezo substrate is removed by etching, thus completing the manufacture.

Figure 8A:
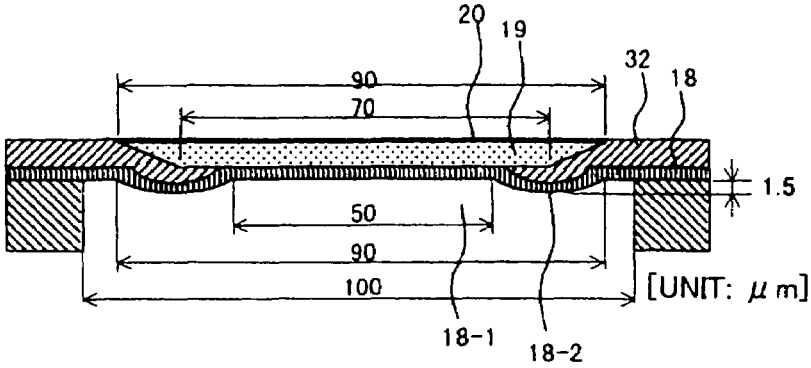
FIGS. 8(A), 8(B) and 8(C) consist of drawings explaining examples of the present invention.
Figure 8B:
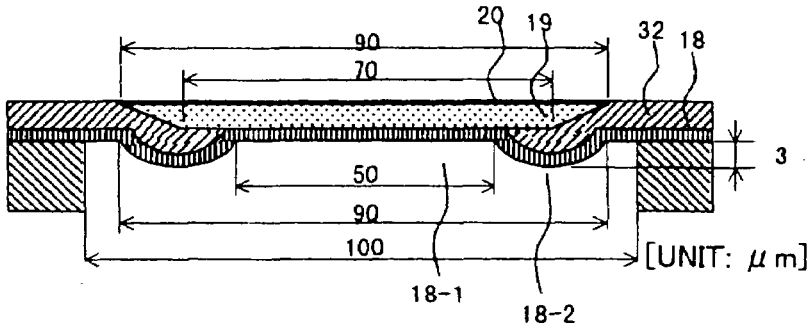
Figure 8C:
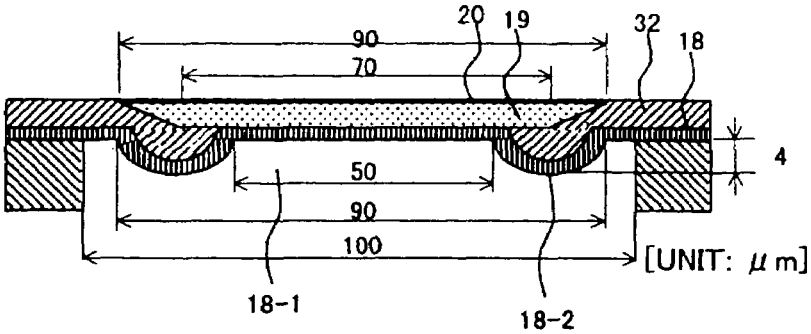

FIGS. 8(A) to (C) show examples of the present invention. The schematic constitution drawings are cross-sections of a pressure chamber (the section is in the direction in which the plurality of pressure chambers are arranged). The driving elements are bimorph structures comprising the diaphragm 18 and the piezos 19. Here, to compare the characteristics of a conventional example and the various examples of the present invention, all were made to have the following common shape.

Individual electrodes: width 90 (μm), thickness 0.1 (μm)

Thin film piezos: piezoelectric constant d31 100 E-12 (m/V), width 70~90 (μm), thickness 3 (μm)

Pressure chambers: length 1700 (μm), width 100 (μm), depth 100 (μm)

Nozzle pitch: 169 (μm) (=150 dpi)

Thickness of pressure chamber walls=nozzle pitch−width of pressure chambers=35 (μm)

Nozzles: length 20 (μm), diameter 20 (μm)

Nozzles formed by excimer laser processing of polyimide (PI) sheet

Lead-through channels: length 50 (μm), diameter 85 (μm)

Ink flow channels formed by etching SUS sheet

Figure 6:
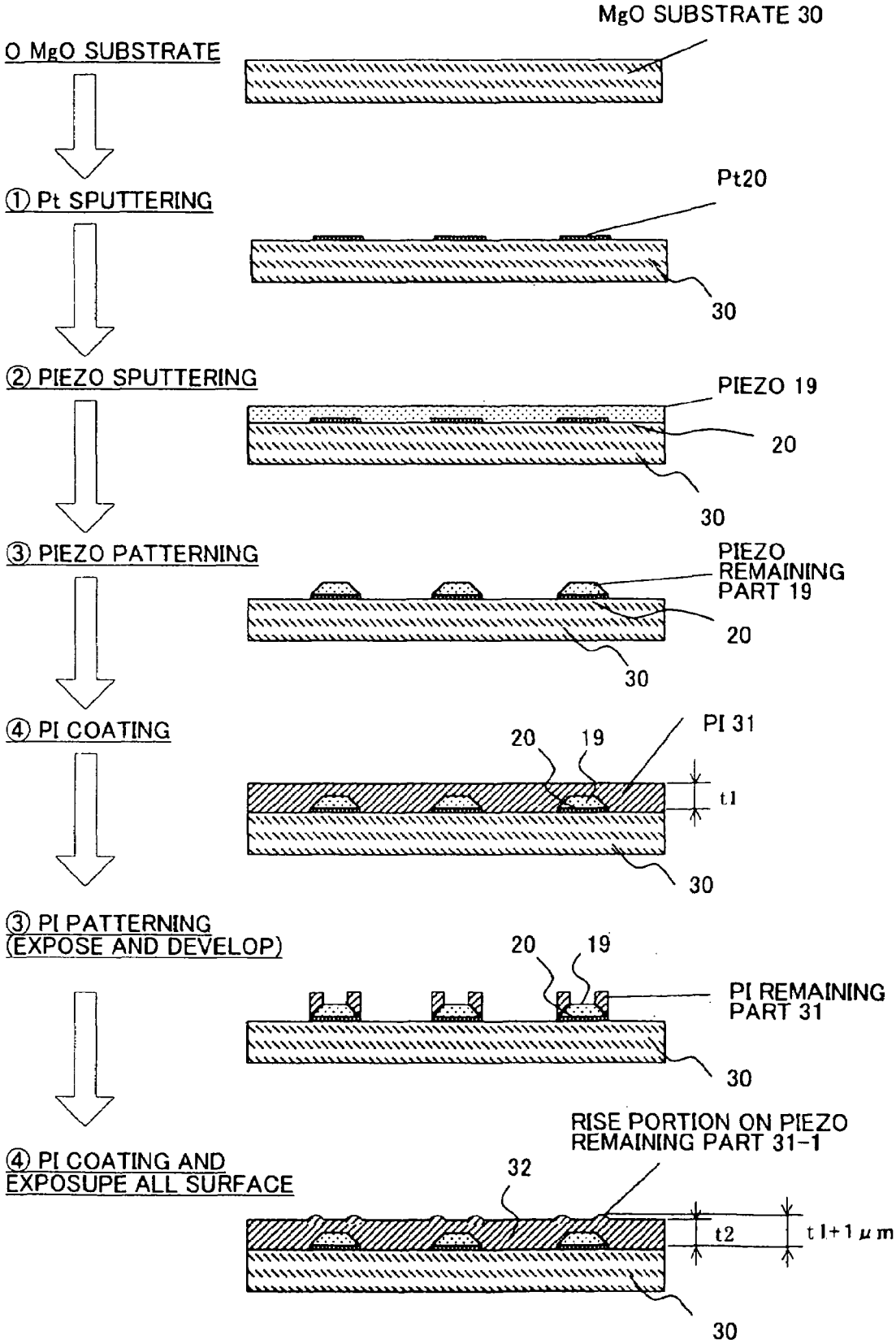
FIG. 6 consists of (first) explanatory drawings of a method of manufacturing the multi-nozzle head of the example of the present invention.
Figure 7:
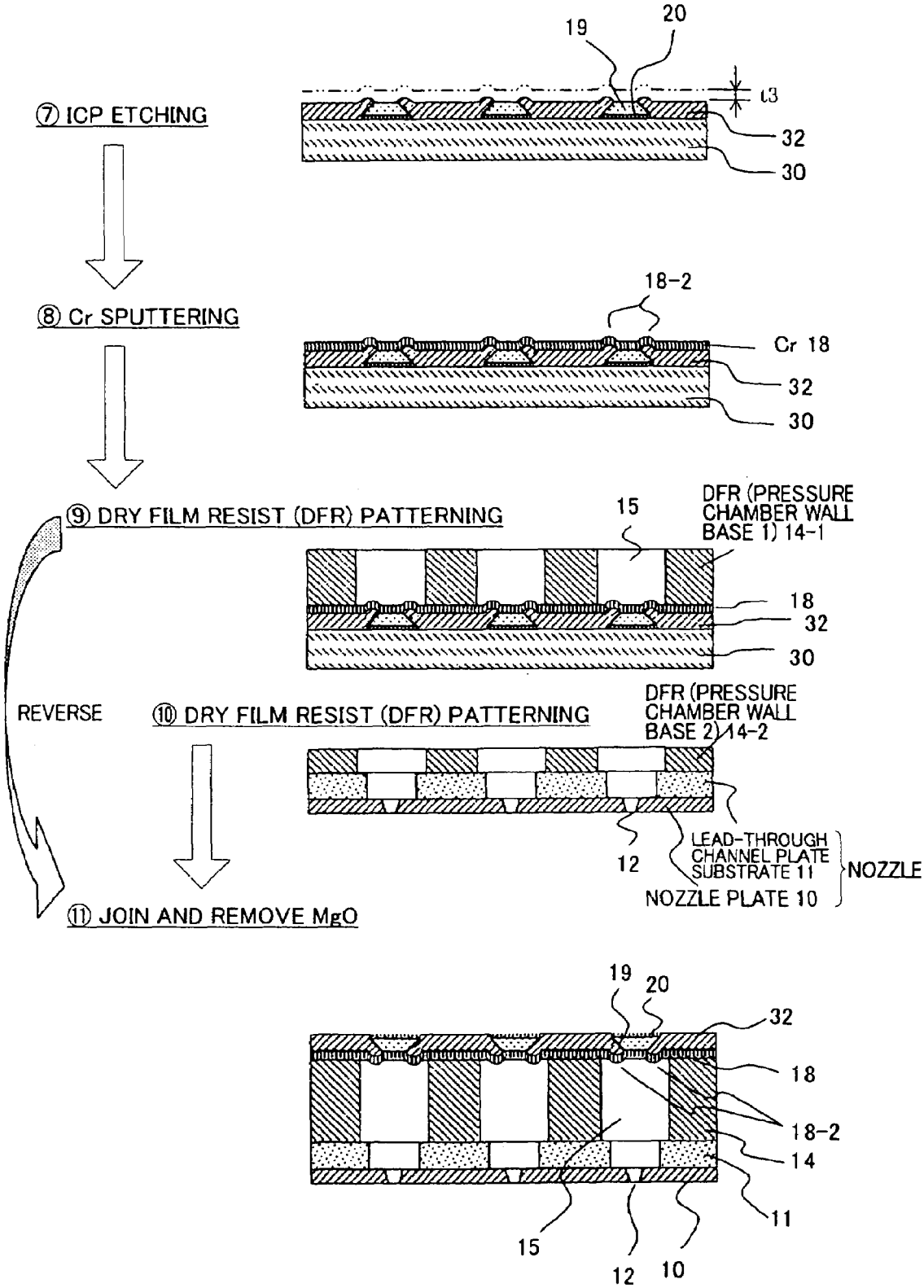
FIG. 7 consists of (second) explanatory drawings of a method of manufacturing the multi-nozzle head of the example of the present invention.
Figure 11:
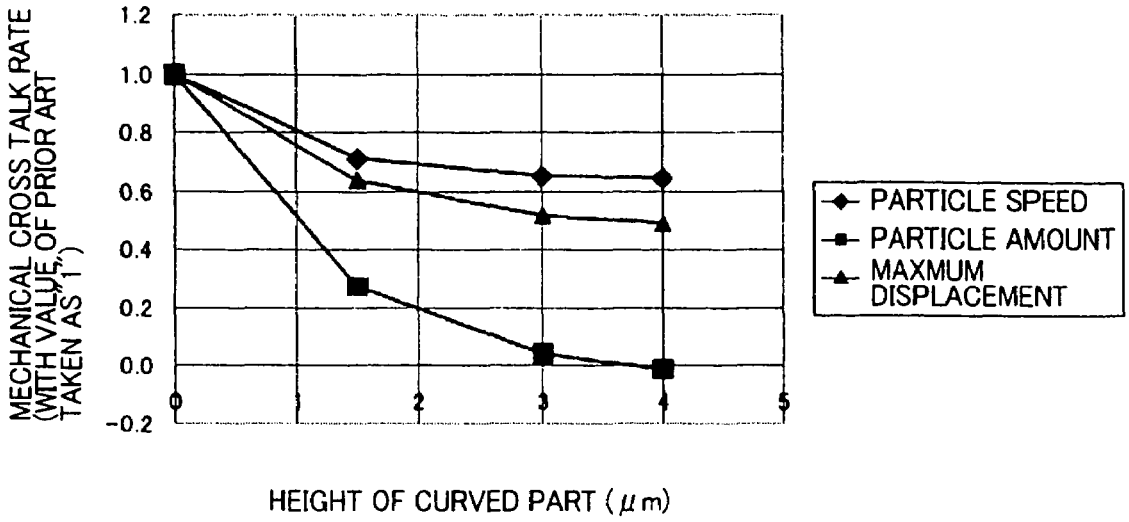
FIG. 11 is a graph of cross talk suppression characteristics versus curvature for FIG. 8.

Here, t1, t2 and t3 shown in FIGS. 6 and 7 were adjusted, thus forming the shapes shown respectively in FIGS. 8(A) to (C), and then the characteristics were evaluated. FIGS. 9, 10 and 11 show a comparison of cross talk characteristics between the examples of the present invention and the conventional example. FIG. 9 shows the head operating characteristics (15V driving) according to the driving state (single-element driving and multi-element driving), and gives a comparison of the particle speed, the particle volume, the maximum displacement, and the resulting cross talk rate.

FIG. 10 shows the effects of the examples of the present invention, with the values for the conventional example being taken as 1 in the cross talk rates of FIG. 9. FIG. 11 is a graph of the cross talk rates of FIG. 10. FIG. 11 has the height of the curved diaphragm parts 18-2 formed in the examples along the horizontal axis, and shows the trend in the effects due to the curved shape. A curve height of 0 corresponds to the conventional example.

From the above, it is clear that by making the diaphragm 18 not flat, but rather by making part of the cross-section thereof be a non-linear irregular shape 18-2 such as a curve as in the examples, mechanical cross talk between adjacent elements can be suppressed compared with conventionally, and it can be seen that this will contribute to suppressing variation in ink flight characteristics (particle speed, particle volume), which is an object of the present patent.

Even if the crosstalk for the shape of the conventional example is within the range of fluctuation for the target product specifications, by using the shape of the present patent, the fluctuation thus suppressed can be transferred over to other processing fluctuation that arises during manufacturing (for example, the processing precision of the nozzle diameter can be relaxed), and hence using the shape of the present patent contributes to making the manufacturing easier.

Moreover, in FIGS. 8(A) to (C), tapered parts are formed at both ends of each piezo 19 by chemical etching, and hence the insulating layer 32 can be interposed between the diaphragm 18 and the piezo 19. Shorting between the electrodes can thus be prevented, and the piezo width required for displacement can be procured. Furthermore, because the non-linear parts 18-2 are made to have a curved shape, manufacturing is easy, and because the shape is a curved surface with no angles, there is no concentration of stress due to the deformation during driving, and hence the structure is strong against breakage.

Figure 12:
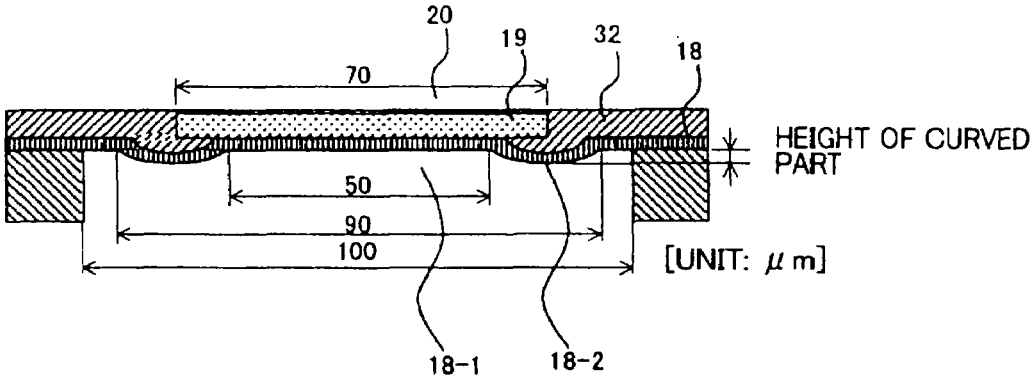
FIG. 12 is an explanatory drawing of another example of the present invention.
Figure 13A:
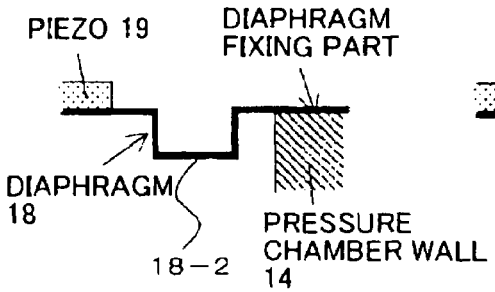
FIGS. 13(A), 13(B), 13(C), 13(D), 13(E), 13(F), 13(G), 13(H), 13(I) and 13(J) consist of explanatory drawings of yet other examples of the present invention.
Figure 13E:
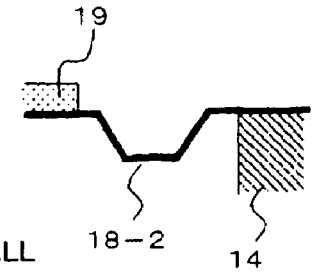
Figure 13H:
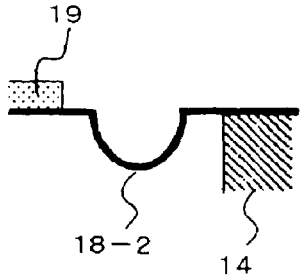
Figure 13B:
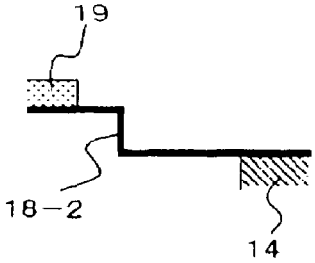
Figure 13F:
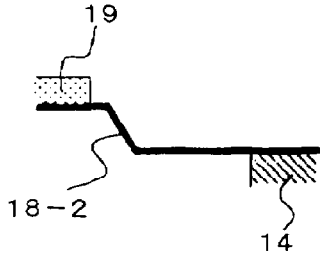
Figure 13I:
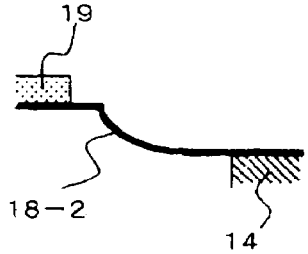
Figure 13C:
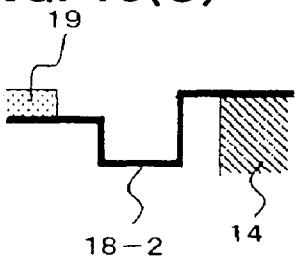
Figure 13G:
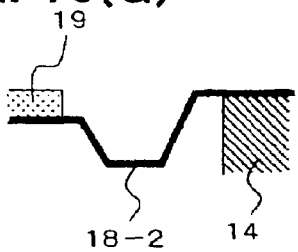
Figure 13J:
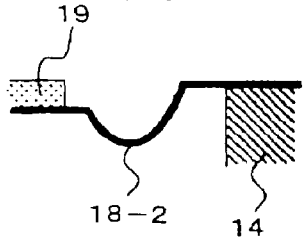
Figure 13D:
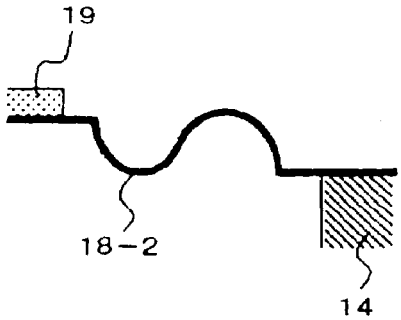
Figure 14:
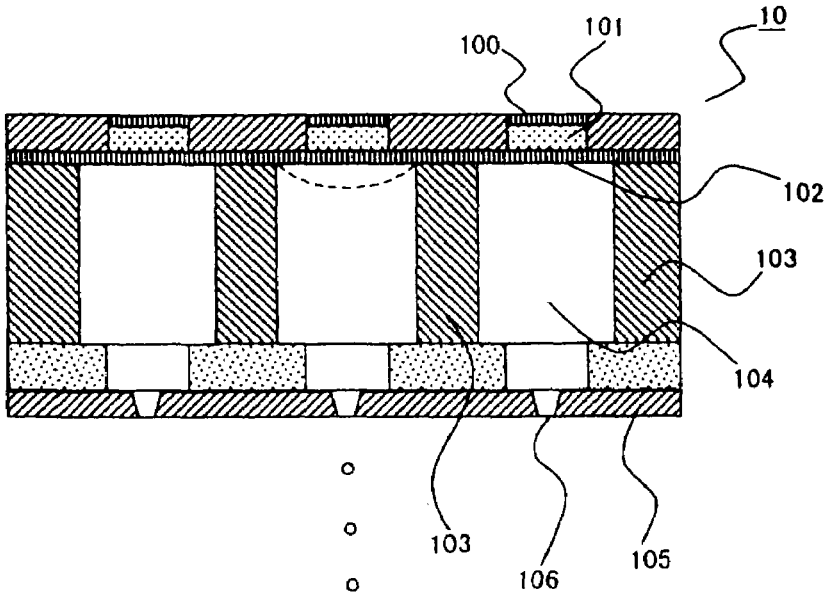
FIG. 14 PRIOR ART
FIG. 14 is a drawing of the constitution of a conventional multi-nozzle ink jet head.
Figure 15:
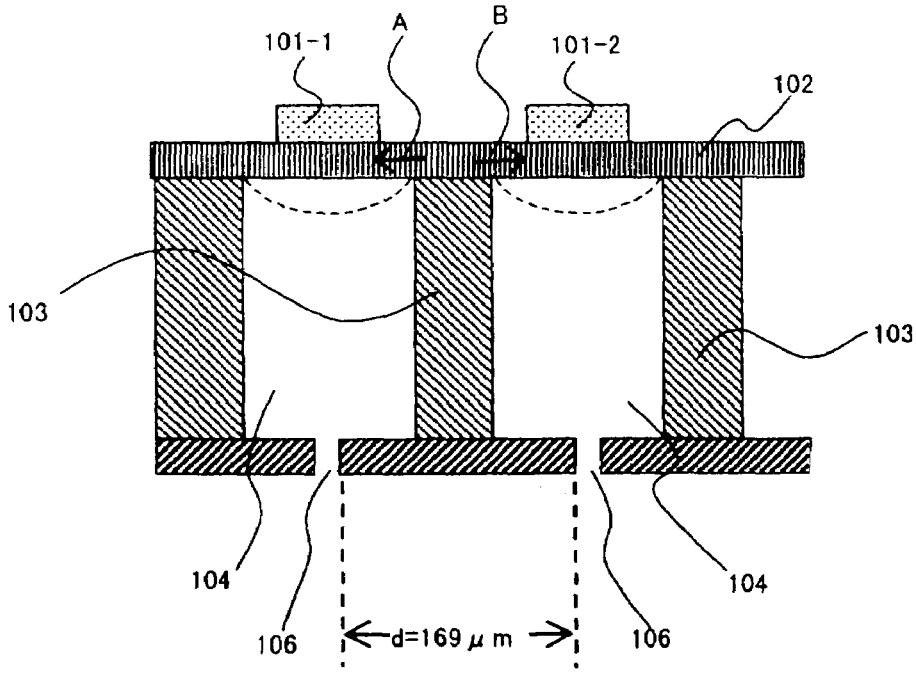
FIG. 15 PRIOR ART
FIG. 15 is a drawing for explaining cross talk in the conventional art.

FIG. 12 is a drawing of the constitution of another example of the present invention. As in FIG. 8, a cross-section is shown. In this example, tapered parts are not formed on the piezos 19. Consequently, the width of the piezo 19 need not cover the whole of the regions of the non-linear parts 18-2. The non-linear parts 18-2 thus bend easily, and hence energy transmission can be suppressed yet better.

FIGS. 13(A) to (J) are drawing of the constitutions of other examples of the present invention, and show examples of modifications of the shape of the non-linear part 18-2. In each of FIGS. 13(A) to (C), the non-linear part 18-2 is made to have a crank shape. In each of FIGS. 13(E) to (G), the non-linear part 18-2 is made to have a tapered crank shape. In each of FIGS. 13(D) and (H) to (J), the non-linear part 18-2 is made to have a curved shape. These examples also exhibit the same effects as above, and the shape can be selected as appropriate in accordance with the expediency of manufacture and design.

The present invention was described through examples above; however, various modifications are possible within the scope of the purport of the present invention, and these are not excluded from the scope of the present invention.

INDUSTRIAL APPLICABILITY

Because non-linear parts are provided in the diaphragm, in the case of a structure having a high nozzle density, i.e. a structure in which the diaphragm fixing parts are narrow, mechanical cross talk between adjacent elements can be suppressed, while securing the fixing of the diaphragm. Moreover, in the case that the diaphragm is used as an electrode for the driving elements, by making the non-linear irregular cross-section parts have a shape that goes away from the driving elements (electrodes that form a pair), electrical shorting is prevented between the end electrodes of the driving element parts that form a finer structure. In particular, in the case of a bimorph diaphragm structure using thin-film piezos of thickness 5 μm or less as actuators, these effects are marked, contributing greatly to increasing the nozzle density and making the head smaller.

The invention claimed is:

1. A method of manufacturing a multi-nozzle ink jet head having a plurality of pressure chambers and a plurality of nozzles that eject ink, comprising the steps of:

forming a plurality of individual electrodes on a substrate;

forming a plurality of piezo elements respectively on said individual electrodes;

forming, on said substrate, an insulating layer having rising parts between regions in which said piezo elements are provided and walls of said pressure chambers;

forming a diaphragm layer on said insulating layer; and forming, on said diaphragm layer, a head substrate in which are formed said plurality of nozzles and a plurality of pressure chambers, such that said piezo elements are respectively positioned at said pressure chambers.

2. The method of manufacturing a multi-nozzle inkjet head according to claim 1, wherein the step of forming said the piezo elements comprises a step of forming piezo elements having tapered parts at both ends, and wherein the step of forming said insulating layer comprises a step of forming, on said substrate, an insulating layer having said rising parts at said tapered parts of said piezo elements.

3. The method of manufacturing a multi-nozzle ink jet head according to claim 1, wherein the step of forming the diaphragm layer comprises a step of forming the diaphragm layer common to said plurality of pressure chambers.

* * * * *